US007841897B2

(12) United States Patent
Blake et al.

(10) Patent No.: US 7,841,897 B2
(45) Date of Patent: Nov. 30, 2010

(54) FOUR-PORT GROUND BLOCK FOR COAXIAL CABLE

(76) Inventors: Joshua Blake, 5600 NW. 12th Ave., Suite 306, Ft. Lauderdale, FL (US) 33309; Jason Cohen, 5600 NW. 12th Ave., Suite 306, Ft. Lauderdale, FL (US) 33309

( * ) Notice: Subject to any disclaimer, the term of this patent is extended or adjusted under 35 U.S.C. 154(b) by 0 days.

(21) Appl. No.: 10/913,818

(22) Filed: Aug. 6, 2004

(65) Prior Publication Data

US 2006/0030181 A1 Feb. 9, 2006

(51) Int. Cl.
*H01R 9/05* (2006.01)

(52) U.S. Cl. ..... 439/579

(58) Field of Classification Search ..... 439/95, 439/98, 101, 108, 610, 954, 579, 63
See application file for complete search history.

(56) References Cited

U.S. PATENT DOCUMENTS 3,989,333 A * 11/1976 Cauldwell ..... 439/76.1
4,875,864 A 10/1989 Campbell
5,334,050 A * 8/1994 Andrews ..... 439/579
5,505,636 A * 4/1996 Blum ..... 439/579
5,829,992 A * 11/1998 Merker et al. ..... 439/98
5,909,063 A * 6/1999 Silliman et al. ..... 307/112
6,297,447 B1 10/2001 Burnett
D459,304 S 6/2002 Malin
D459,305 S 6/2002 Malin
D459,306 S 6/2002 Malin
6,431,885 B1 8/2002 Stroup

* cited by examiner

*Primary Examiner*—Tulsidas C. Patel
*Assistant Examiner*—Vladimir Imas
(74) *Attorney, Agent, or Firm*—ARC IP Law, PC; Joseph J. Mayo

(57) ABSTRACT

A four-port coaxial cable ground block is provided with four angularly spaced connection ports disposed for providing sufficient access for convenient connection and tightening of four coaxial cables thereby eliminating the need for use of a plurality of ground blocks in four cable applications. Opposing left and right side ground connections are provided for connection of ground wires thereby providing a common ground point for electrical grounding of a satellite dish all four connected coaxial cables thereby eliminating problems associated with multiple ground wire connections. The four-port ground block provides an improved multi-port ground block for use in connecting and grounding coaxial cable systems, particularly coaxial cables used in connection with DBS satellite dish systems.

2 Claims, 4 Drawing Sheets

FOUR-PORT GROUND BLOCK FOR COAXIAL CABLE

CROSS REFERENCE TO RELATED APPLICATIONS

N/A

STATEMENT REGARDING FEDERALLY SPONSORED RESEARCH OR DEVELOPMENT

N/A

COPYRIGHT NOTICE

A portion of the disclosure of this patent document contains material that is subject to copyright protection. The copyright owner has no objection to the facsimile reproduction by anyone of the patent document or patent disclosure as it appears in the Patent and Trademark Office patent file or records, but otherwise reserves all copyrights rights whatsoever.

BACKGROUND OF THE INVENTION

1. Field of the Invention

The present invention relates to an apparatus for electrically grounding a coaxial cable and, more particularly, to a multi-port ground block useful in the electrical connection and grounding of a receiver, such as satellite dish, and a plurality of coaxial cables.

2. Description of Related Art

The use of satellite dishes to receive cable TV and radio signals from orbiting satellites has expanded significantly in recent years. Direct Broadcast Satellite ("DBS") is broadcast by medium and high powered satellites operating in the microwave Ku band. These high powered, high frequency satellites make it possible for the signals to be picked up on a small dish. Digital compression makes it possible to have many channels on a single satellite. The current major DBS systems that are operating in the USA are DIRECTV and DISH Network. The DIRECTV and DISH Network systems both have 18 inch satellite dishes. One of the big advantages of DBS systems is that the small dish does not have to move.

Signals received by a satellite dish are often carried from the dish on conventional coaxial cables. In a typical coaxial cable installation, coaxial cable is run from the satellite dish to the approximate point of entry into the building where it is cut and provided with a conventional coaxial connector including a threaded end sleeve. Similarly, a coaxial cable is run from a tuner located within the building through the building wall and provided on its outside end with an identical standard end fitting. Connection between the terminated ends of the main incoming cable and the cable from within the building is made by utilizing a coaxial cable junction block.

Conventional junction blocks are metallic devices adapted for in-line connection of coaxial cables. Junction blocks typically include a pair of axially aligned and oppositely extending threaded connector studs to which the respective threaded sleeves of the cable end fittings are attached thereby connecting the two sections of coaxial cable. In addition, dual port junction blocks having a pair of axially aligned and oppositely extending connector studs are used in applications involving multiple coaxial cables.

With the use of coaxial cable junction blocks, installers are able to install interior and exterior runs of coaxial cable independently of one another and connect the interior and exterior runs at the junction block. The junction block, however, must be separately attached to the outer wall or other portion of the building and, additionally, a separate grounding connection must be made from the block to a suitable ground, such as an electrical conduit, pipe, or the like. Thus, the installer must drill holes or otherwise provide some means for attachment of the junction block to the building and must additionally repair and attach a separate ground lead between the junction block and the grounded conduit or the like. Providing an appropriate attachment of the junction block to the building may be difficult or objectionable to the owner. In addition, providing a separate grounding connection is also time consuming and requires the use of additional materials.

Grounding is the intentional connection to earth's electrical potential (e.g. ground potential) through an electrical connection of low impedance. The purpose of grounding is to assist in preventing the destruction of electrical components, and property damage from superimposed voltage from lightning and voltage transients. In addition, grounding helps in reducing static charges on equipment surfaces there ensuring proper performance of sensitive electronic equipment.

One of the primary purposes of grounding communications equipment to the earth is to reduce high voltage from lightning from entering into the building or structure via metal raceways or cables. If the metal parts of communication equipment are not grounded in accordance with the NEC, much of the high energy from the lightning strike will be dissipated within the structure, which can result in equipment and property damage as well as the potential for electric shock. Grounding also helps in reducing the build-up of static charges on equipment and material and establishing a zero voltage reference point to ensure proper performance of sensitive communications equipment.

As a result of increased use of coaxial cables in satellite and cable TV applications, and the importance of electrically grounding those systems, the prior art reveals a number of advancements and improvements directed to coaxial cable ground blocks.

U.S. Pat. No. 6,297,447, issued to Burnett et al., discloses a ground connection bracket for securing coaxial cables to a grounding surface. The device includes two clamping members connected along a common edge by an integral hinge such that they may be squeezed together around the cables thereby gripping them. Each of the clamping members is composed of a generally flat, rectangular panel and has two parallel side walls extending therefrom along edges perpendicular to the hinge edge. A hole passes through the panel of one of the clamp members to receive a bolt for fastening the bracket to a grounding surface. One or more coaxial cables are inserted between the clamping members so as to extend through the notches. Contacts are disposed on the clamping members to contact conductive portions of the cables and the bracket is secured to the electrical ground.

U.S. Pat. No. 5,829,992, issued to Merker et al., discloses a single port device for grounding or electrically bonding a cable television connector and eliminating a jumper wire connection, comprising a television cable connector having a threaded large diameter portion tapering to a threaded small diameter end portion; a planar block of conductive material having various configurations connecting the connector parallel to a ground/bond wire. The block can have a plurality of throughbore sets for grounding/bonding a plurality of cable television connectors. Merker et al. further discloses a multi-port embodiment wherein the ports are aligned in linear space relation.

U.S. Pat. No. 4,875,864, issued to Campbell, discloses a coaxial cable junction block provided with an adjustable mounting strap for direct attachment to a tubular grounding member. The junction block is intended to provide a direct ground connection for the block and attached outer conductors of the interconnected coaxial cable sections, eliminating the need to provide mounting holes in a building side wall or the like, and direct grounding of the cable sections without the need for a separate ground wire connection.

U.S. Design Pat. Nos. D459,304, and D459,306, each issued to Malin, disclose ornamental designs for a single-port and dual-port ground blocks. U.S. Design Pat. No. D459,305, also issued to Malin, discloses an ornamental design for a dual-port ground block wherein the coaxial cable connectors are in spaced linear relation.

While the coaxial cable ground blocks disclosed in the background art appear generally suitable for certain applications there remain a number of structural and functional limitations present in the prior art devices. A significant limitation involves the number of coaxial cables that the prior art devices are designed for use with. More particularly, most ground blocks are either single port or dual port, and are thus only capable of use with one or two coaxial cables. Accordingly, a plurality of ground blocks must be used in systems having more than one or two coaxial cables thereby requiring multiple ground wire connections. In addition, the prior art multi-port ground blocks disclosed include ports that are closely spaced and linearly aligned thereby increasing the difficulty of connecting the coaxial cables. Accordingly, there exists a need for an improved multi-port ground block adapted to provide easy connection and grounding of four coaxial cables.

BRIEF SUMMARY OF THE INVENTION

In accordance with the present invention, a four-port coaxial cable ground block is provided with four angularly spaced connection ports disposed for providing sufficient access for convenient connection and tightening of four coaxial cables thereby eliminating the need for use of a plurality of ground blocks in four cable applications. The four-port ground block further provides opposing left and right side ground connections for connection of a ground wire thereby providing a common ground point for electrical grounding of a satellite dish all four connected coaxial cables thereby eliminating problems associated with multiple ground wire connections. The present invention thus provides an improved multi-port ground block for use in connecting and grounding coaxial cable systems, particularly coaxial cables used in connection with DBS satellite dish systems.

Accordingly, it is an object of the present invention to provide an improved multi-port ground block for use with coaxial cables.

Another object of the present invention is to provide a four-port ground block for use with coaxial cables.

Yet another object of the present invention is to provide a four-port ground block wherein coaxial cable connection ports are disposed in angularly spaced relation thereby providing clearance for the connection and tightening of four coaxial cables in a compact device.

In accordance with these and other objects, which will become apparent hereinafter, the instant invention will now be described with particular reference to the accompanying drawings.

DETAILED DESCRIPTION OF THE INVENTION

Figure 1:
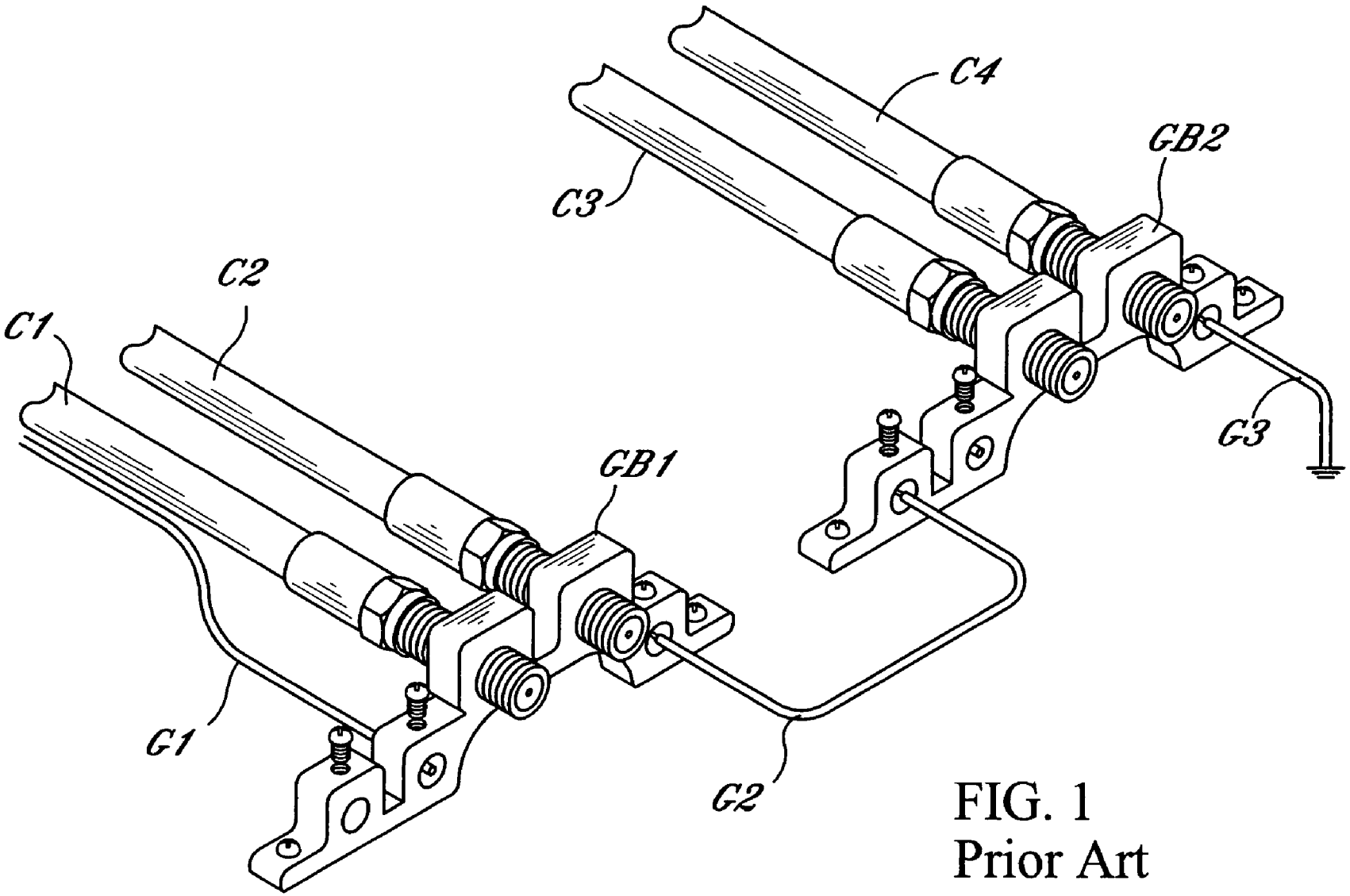
FIG. 1 Prior Art
FIG. 1 is a perspective view illustrating the use of two dual-port ground blocks in the connection of four coaxial cables in accordance with the prior art.

With reference now to the drawings, FIG. 1 depicts four coaxial cables, referenced as C1–C4, and a satellite dish ground wire G1 connected using a pair of dual port ground blocks in accordance with the prior art. Recent developments in DBS receiving systems have resulted in single dish units capable of providing four output signals to receivers located within residence. As a result, installations must be adapted with sufficient hardware to accommodate four coaxial cables and a ground wire.

As illustrated in FIG. 1, installers have responded to the increased number of coaxial cables in DBS installations by providing multiple ground blocks, referenced as GB1 and GB2. FIG. 1 depicts a typical installation in accordance with the prior art wherein two dual-port ground blocks are used to provide an in-line splice of four coaxial cables C1, C2, C3, and C4 at the building exterior prior to attachment of end run cables from the ground blocks to receives housed within the building. The use of two ground blocks GB1 and GB2 increases the complexity of the installation by requiring additional mounting steps and additional ground wire connections. More particularly, the prior art installation requires an additional ground wire bridge, referenced as G2, connecting the two ground blocks. The requirement for additional grounding connections renders the installation burdensome to install and subject to failure of the grounding link.

Figure 2:
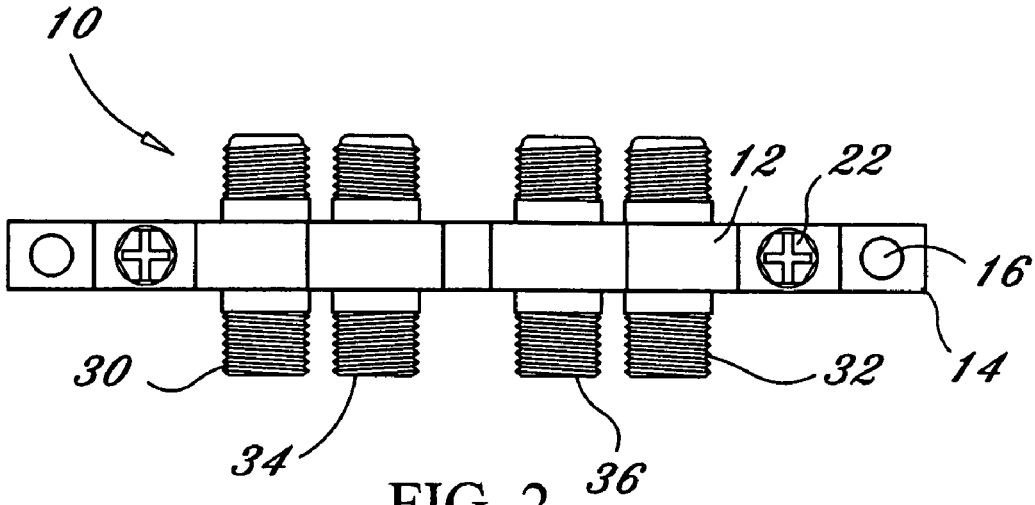
FIG. 2 is a top view of a preferred embodiment of a four-port ground block in accordance with the present invention.
Figure 3:
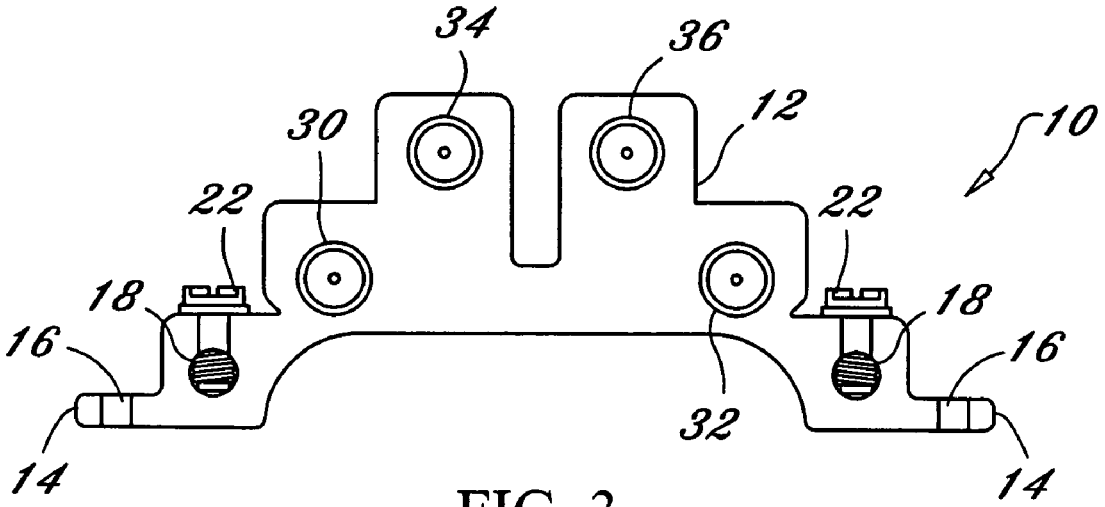
FIG. 3 is a front view thereof.
Figure 4:
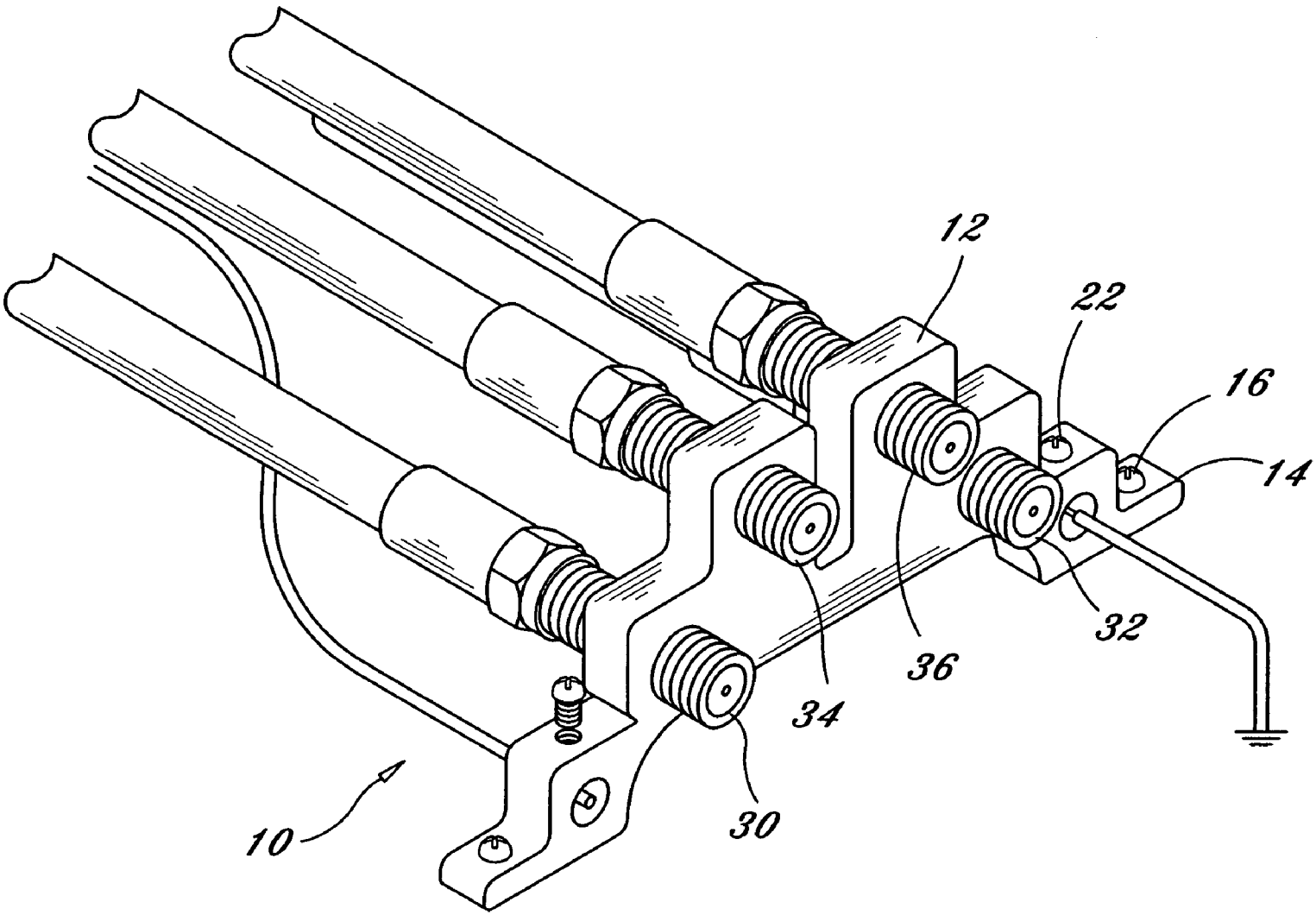
FIG. 4 is a perspective view illustrating use of the four-port ground block in the connection of four coaxial cables and a ground wire.

FIGS. 2–4 depict a four-port coaxial cable ground block, generally referenced as 10, according to a preferred embodiment of the present invention. Ground block 10 includes a main body portion 12 fabricated from an electrically conducting material. Ground block body 12 generally includes a pair of opposed laterally projecting flanges 14 each of which defines an aperture 16 for use in receiving suitable fasteners for anchoring ground block 10 to a mounting surface. Ground block body 12 further includes left and right side ground wire connection points 18, each of which define an aperture 20 and a mating threaded set screw 22 that cooperate to function as connection points for ground wires as further discussed hereinbelow.

A further significant improvement present in ground block 10 relates to providing four spaced coaxial cable connection ports with projecting connection studs, referenced as 30, 32, 34, and 36 respectively. More particularly, each of the four connection ports includes axially opposed externally threaded projecting coaxial cable connection studs adapted for connection to a conventional coaxial cable end connector. Each pair of opposing connecting studs preferably comprise an F-81 in-line splice connector, however, any suitable means for connecting to a coaxial cable are considered within the scope of the present invention. A significant aspect of the present invention relates to the position and spacing of the connection studs. Specifically, the connection studs are disposed and angularly spaced for providing sufficient access for convenient connection and tightening of four coaxial cables while eliminating the need for use of a plurality of ground blocks in four cable applications.

As best depicted in FIG. 3, ground block 10 includes two connection studs, referenced as 30 and 32, each of which includes axially opposed stud members, as depicted in FIG. 2, which cooperate to provide input and output connection ports. Connection studs 30 and 32 are disposed in lower outboard positions relative to the center of the block and are thus positioned substantially adjacent to ground wire connection points 18. Ground block 10 further includes an additional two connection studs, referenced as 34 and 36, disposed in upper inboard positions. The angular spacing between studs 30 and 34, and similarly between studs 32 and 36, provides additional clearance between adjacent connection studs to allow space for connection and tightening of coaxial cables. The spacing provides a significant advantage over prior art ground blocks wherein connection studs are in liner alignment. In a preferred embodiment, the spacing between studs 30 and 32 is approximately 44 millimeters (mm), and the spacing between studs 34 and 36 is approximately 20 mm, thus the distance between studs 30 and 32 is greater than the distance between the studs 34 and 36. Also, an area defined between said coaxial cable splice connectors comprising a free area devoid of projecting structures thereby providing access for connection of coaxial cables. In addition, the respective centerline spacing between studs 30 and 34, and similarly between studs 32 and 36, is approximately 18.44 mm, or 12.0 mm lateral spacing and 14.0 mm vertical spacing relative to the view depicted in FIG. 3. The two tiered configuration and angular spacing between the studs maximizes available clearance while minimizing the ground block footprint.

As further depicted in FIG. 4, use of the four-port ground block disclosed herein eliminates the requirement for two separate ground blocks connected by a bridge ground wire, as seen in the prior art installation shown in FIG. 1. More particularly, with reference to FIG. 4, ground block 10 is adapted for providing an in-line splice of four coaxial cables on a single ground block structure. In addition, ground block 10 provides left and right side ground wire connection points, one of which functions to receive a ground wire from the satellite dish and the other functions to receive a ground wire from a suitable grounding structure, such as a metal rod inserted directly into the earth. Accordingly, the four-port ground block provides opposing left and right side ground connections for connection of a ground wire thereby providing a common ground point for electrical grounding of a satellite dish and all four connected coaxial cables thereby eliminating problems associated with multiple ground wire connections. The present invention thus provides an improved multi-port ground block for use in connecting and grounding coaxial cable systems, particularly coaxial cables used in connection with DBS satellite dish systems.

Figure 5:
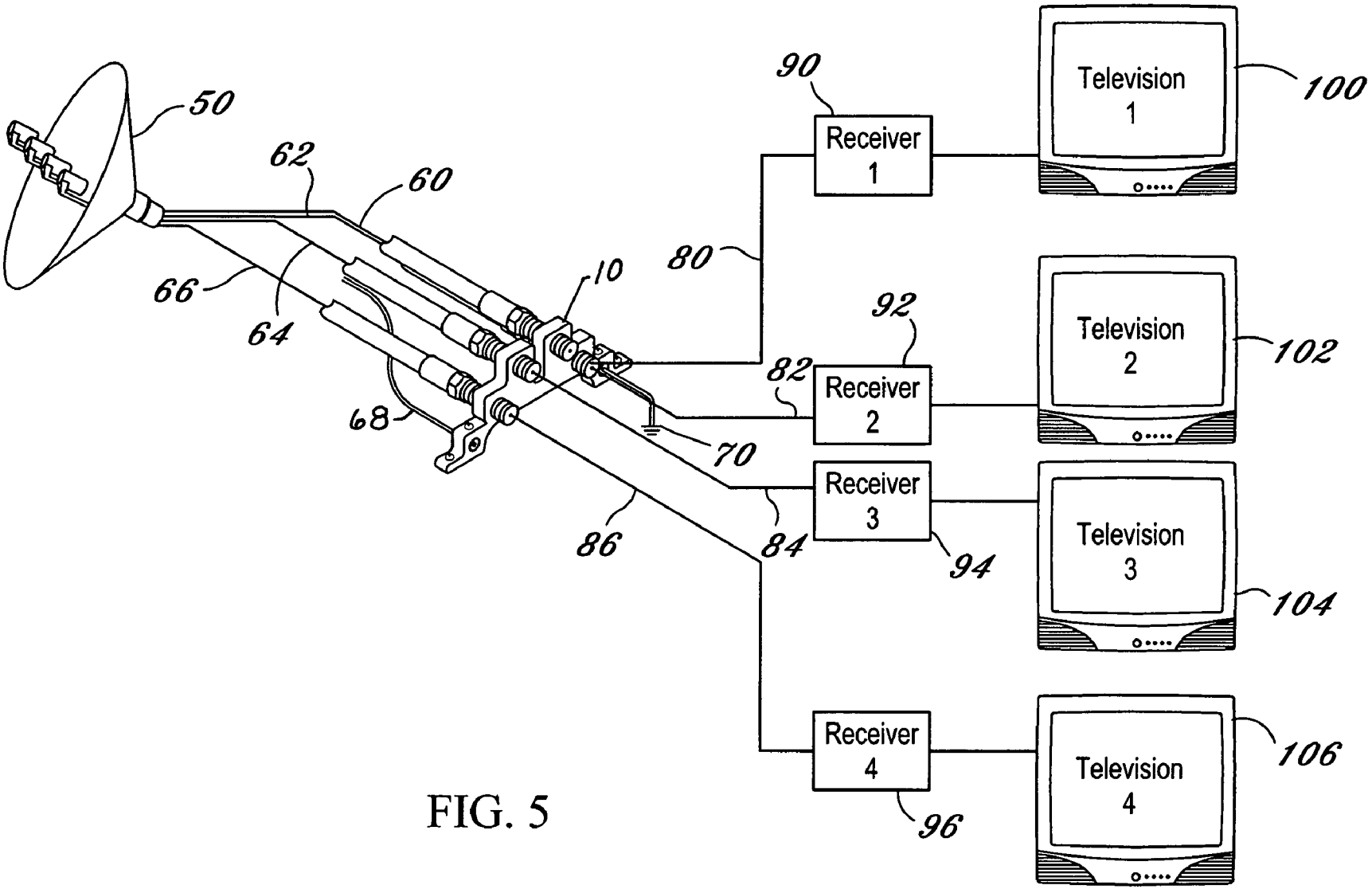
FIG. 5 is an electrical schematic depicting a DBS satellite dish installation incorporating a four-port ground block in accordance with the present invention connected to four coaxial cables and a satellite dish ground wire to provide signals to four receiver/television sets.

FIG. 5 is an electrical schematic illustrating use of a four-port ground block 10 in accordance with the present invention. More particularly, FIG. 5 depicts a DBS satellite dish 50 adapted with four coaxial outputs, each of which is connected to a coaxial cable, referenced as 60, 62, 64, and 66 respectively. Each coaxial cable 60–66 has an opposing end connected to an input stud on a four-port ground block 10 in accordance with the present invention. In addition, satellite dish 50 is connected to a ground wire 68 which has an opposing end connected to a ground wire connection point 18 on ground block 10. Ground block 10 further includes a second ground wire 70 having a first end connected thereto and a second end connected to a grounding stake embedded in the earth, or other suitable grounding point. As noted hereinabove, ground block 10 is preferably anchored to the exterior wall of a structure (not shown) by suitable fasteners 16 disposed through flanges 14. In addition, ground block 10 includes output studs connected to four coaxial output cables, referenced as 80, 82, 84, and 86. Each coaxial output cable is connected to a receiver 90, 92, 94, and 96 respectively. Finally, each receiver is connected to a television, referenced as 100, 102, 104, and 106.

The instant invention has been shown and described herein in what is considered to be the most practical and preferred embodiment. It is recognized, however, that departures may be made therefrom within the scope of the invention and that obvious modifications will occur to a person skilled in the art.

What is claimed is:

1. A coaxial cable ground block apparatus for interconnecting coaxial cables and a ground wire in a satellite dish installation, said apparatus comprising:

an electrically conducting ground block body having a top portion, and bottom portion and opposing left and right flanges projecting proximal said bottom portion, each flange defining an aperture for receiving a fastener for anchoring the ground block body to a surface;

said ground block body including first and second grounding points, each of said grounding points including means for connecting a ground wire to said ground block body; and said ground block body including first and second in-line coaxial cable splice connectors disposed proximal said ground block bottom portion and third and fourth in-line coaxial cable splice connectors disposed proximal said ground block top portion, each of said connector having axially opposing externally threaded connection studs;

said first and second in-line splice connectors being spaced a first distance apart and generally centered relative to said ground block body;

said third and fourth in-line splice connectors being spaced a second distance apart and generally centered relative to said ground block body;

said first distance being greater than said second distance such that said first and second; and an area defined between said coaxial cable splice connectors comprising a free area devoid of projecting structures thereby providing access for connection of coaxial cables.

2. A coaxial cable ground block apparatus for interconnecting coaxial cables and a ground wire in a satellite dish installation, said apparatus comprising:

an electrically conducting ground block body having a top portion, and bottom portion and opposing left and right flanges projecting proximal said bottom portion, each flange defining an aperture for receiving a fastener for anchoring the ground block body to a surface;

said ground block body including first and second grounding points, each of said grounding points including means for connecting a ground wire to said ground block body; and said ground block body including first and second in-line coaxial cable splice connectors disposed proximal said ground block bottom portion and third and fourth in-line coaxial cable splice connectors disposed proximal said ground block top portion, each of said connector having axially opposing externally threaded connection studs;

said first and second in-line splice connectors being spaced a first distance apart and generally centered relative to said ground block body;

said third and fourth in-line splice connectors being spaced a second distance apart and generally centered relative to said ground block body;

said first distance being greater than said second distance such that said connectors are disposed in trapezoidal relation with each connector surrounded by free area devoid of projecting structures thereby providing access for connection of coaxial cables.

* * * * *